US008813446B2

(12) United States Patent
Sladojevic

(10) Patent No.: US 8,813,446 B2
(45) Date of Patent: Aug. 26, 2014

(54) CAST-IN INSERT

(75) Inventor: Radovan Sladojevic, Cherry Gardens (AU)

(73) Assignee: Casne Verige Pty Ltd, Kent Town, South Australia (AU)

( * ) Notice: Subject to any disclaimer, the term of this patent is extended or adjusted under 35 U.S.C. 154(b) by 0 days.

(21) Appl. No.: 12/810,009

(22) PCT Filed: Dec. 19, 2008

(86) PCT No.: PCT/AU2008/001878

§ 371 (c)(1),
(2), (4) Date: Aug. 13, 2010

(87) PCT Pub. No.: WO2009/079697

PCT Pub. Date: Jul. 2, 2009

(65) Prior Publication Data

US 2010/0293883 A1 Nov. 25, 2010

(30) Foreign Application Priority Data

Dec. 21, 2007 (AU) ..... 2007907058

(51) Int. Cl.

| | |
|---|---|
| ***E04C 5/08*** | (2006.01) |
| ***E04B 1/41*** | (2006.01) |
| ***B28B 23/00*** | (2006.01) |
| ***E04G 21/18*** | (2006.01) |
| ***E04G 21/14*** | (2006.01) |
| ***E04G 5/04*** | (2006.01) |

(52) U.S. Cl.

CPC ..... *E04B 1/4114* (2013.01); *B28B 23/0056* (2013.01); *E04G 21/185* (2013.01); *E04G 21/142* (2013.01); *E04G 5/04* (2013.01); *Y10S 52/06* (2013.01)

USPC ..... 52/223.13; 52/DIG. 6; 52/295; 52/298; 52/127.12; 52/707; 52/704

(58) Field of Classification Search

USPC ..... 52/701, 705, DIG. 6, 165, 295, 298, 52/223.13, 184, 187, 223.14, 223.1, 223.6, 52/583.1, 127.12, 698, 699, 704, 707, 319, 52/710, 711; 249/91, 94; 182/90, 92; 285/322, 307, 323, 340, 324; 411/82, 411/258, 113

See application file for complete search history.

(56) References Cited

U.S. PATENT DOCUMENTS 3,561,307 A 2/1971 Mortensen
3,612,287 A * 10/1971 Maltese ..... 52/298

(Continued)

FOREIGN PATENT DOCUMENTS

CN 2145889 Y 11/1993
FR 1258300 A 4/1961

(Continued)

OTHER PUBLICATIONS

International Search Report mailed Mar. 12, 2009, for PCT Application No. PCT/AU08/01878 filed Dec. 19, 2008, 4 pages.

(Continued)

*Primary Examiner* — Chi Q Nguyen
(74) *Attorney, Agent, or Firm* — Morrison & Foerster LLP

(57) ABSTRACT

An insert for embedment in a concrete component during casting, having a tubular cavity for receiving a threaded anchorage member, the tubular cavity having an opening arranged to face outward of the concrete component when cast for insertion of the threaded anchorage member, wherein the insert is externally tapered such that, when the insert is embedded in the concrete component and the anchorage member is threadedly engaged within the tubular cavity, axial loading applied to the anchorage member in a sense to withdraw the anchorage member from the insert causes reactional force from the surrounding concrete to be applied to the insert in a direction radially inwardly of the insert, and wherein the insert is formed of deformable plastic material such that said reactional force in turn causes the insert to exert force radially inwardly upon the anchorage member.

17 Claims, 11 Drawing Sheets

(56) References Cited

U.S. PATENT DOCUMENTS

| | | | | |
|---|---|---|---|---|
| 3,835,615 | A * | 9/1974 | King, Jr. | 403/408.1 |
| 4,455,717 | A * | 6/1984 | Gray | 24/115 R |
| 5,060,436 | A * | 10/1991 | Delgado, Jr. | 52/295 |
| 5,072,558 | A * | 12/1991 | Sorkin et al. | 52/223.13 |
| 5,517,729 | A * | 5/1996 | Shaffer | 24/30.5 R |
| 5,632,464 | A * | 5/1997 | Aberle | 248/530 |
| 5,752,349 | A * | 5/1998 | Fitzsimmons et al. | 52/165 |
| 5,807,051 | A * | 9/1998 | Heminger | 411/82 |
| 6,315,077 | B1 * | 11/2001 | Peacock et al. | 182/92 |
| 6,327,829 | B1 * | 12/2001 | Taguchi | 52/583.1 |
| 6,764,042 | B2 * | 7/2004 | Moore et al. | 244/3.28 |
| 6,988,747 | B2 * | 1/2006 | Allen et al. | 285/322 |
| 7,387,288 | B2 * | 6/2008 | Hull et al. | 249/91 |
| 7,726,082 | B2 * | 6/2010 | Hayes et al. | 52/223.13 |
| 7,891,110 | B2 * | 2/2011 | Diaz | 33/562 |
| 7,954,289 | B2 * | 6/2011 | Evans | 52/298 |
| 8,282,083 | B1 * | 10/2012 | Poma | 256/65.01 |

FOREIGN PATENT DOCUMENTS

| | | | |
|---|---|---|---|
| GB | 618388 | A | 2/1949 |
| JP | 09-177183 | A | 7/1997 |
| JP | 2000-345501 | A | 12/2000 |

OTHER PUBLICATIONS

Notice of Acceptance received for Australian Patent Application No. 2008255268, mailed on Nov. 15, 2010, 1 page.

Examiner First Report received for Australian Patent Application No. 2008255268, mailed on Apr. 9, 2010, 2 pages.

* cited by examiner

CAST-IN INSERT

CROSS REFERENCE TO RELATED APPLICATIONS

This is a U.S. National Phase patent application of PCT/AU2008/001878, filed Dec. 19, 2008, which claims priority to Australian patent application Serial No. AU 2007907058, filed Dec. 21, 2007, all of which are hereby incorporated by reference in the present disclosure in their entirety.

BACKGROUND

1. Field

The present invention relates to an insert to be incorporated into a concrete component, such as a wall panel, slab, or beam, to provide an anchorage point in the component.

2. Description of the Related Art

Cast-in ferrules or inserts for providing an anchorage point within a concrete component are conventionally fabricated from metal and are internally threaded for engagement with a bolt or other anchor member such as a length of reinforcing rod. The ferrule, usually of cast steel, is of robust construction and provides a strong anchorage and while this is essential in many situations, circumstances do arise in which the ferrule is to be used as a temporary anchorage and subject to comparatively low loadings or used for moderate loading in applications in corrosive environments. Examples of such usage include the fixing of formwork for on-site casting, the fixing of temporary bracing props, and permanent fixing of signage. In practice, in the absence of a suitable alternative, conventional ferrules are used for providing temporary anchorages such as these, and stainless steel ferrules are used in corrosive environments. However, conventional ferrules and stainless steel ferrules are relatively expensive and are "over-engineered" for many of these uses.

The present invention seeks to provide a cast-in insert of plastics suitable for use in reduced load situations, particularly when only a temporary anchorage is required.

BRIEF SUMMARY

In accordance with one aspect of the present invention, there is provided an insert for embedment in a concrete component during casting, having a tubular cavity for receiving a threaded anchorage member, the tubular cavity having an opening arranged to face outward of the concrete component when cast for insertion of the threaded anchorage member, wherein the insert is externally tapered such that, when the insert is embedded in the concrete component and the anchorage member is threadedly engaged within the tubular cavity, axial loading applied to the anchorage member in a sense to withdraw the anchorage member from the insert causes reactional force from the surrounding concrete to be applied to the insert in a direction radially inwardly of the insert, and wherein the insert is formed of deformable plastic material such that said reactional force in turn causes the insert to exert force radially inwardly upon the anchorage member.

Preferably, an internal surface defining the tubular cavity is provided with grooves extending longitudinally of the insert, the grooves defining therebetween a series of angularly spaced surfaces which circumferentially contract onto the anchorage member in jaw-like fashion in response to the reactional force. More preferably, each of the spaced surfaces is part cylindrical.

Preferably, the internal surface is adapted for having a thread formed therein during threaded insertion of a self-tapping anchorage member. In one form, the spaced surfaces are plane and are tapped by the anchorage member when the anchorage member is inserted in the tubular cavity.

Preferably, the external tapering of the insert is provided by way of longitudinally tapered fins arranged along an external surface of the insert. More preferably, the longitudinally tapered fins are evenly angularly spaced about the insert. Even more preferably, the tapered longitudinal fins extend along a substantial part of the length of the insert.

More preferably, the insert has the same number of grooves as it does fins, and each groove is located between a respective pair of neighbouring fins. More preferably still, each groove is located substantially midway between a respective pair of neighbouring fins such that reactional force applied to the fins is transmitted substantially centrally to each of the spaced surfaces.

Preferably, the insert includes a collar located around the tubular cavity. More preferably, the collar is arranged so as to be tapped by the anchorage member when the anchorage member is inserted in the tubular cavity.

Preferably, the collar is located at a front portion of the insert. Alternatively, the collar is located at a middle portion of the insert, and protrudes beyond an external dimension of the insert.

Preferably, the collar is formed of metal.

In accordance with another aspect of the present invention, there is provided a plastic ferrule adapted for embedment in a concrete component during casting, the ferrule having a tubular cavity for receiving a threaded anchorage member, the tubular cavity having an opening arranged to face outward of the concrete component when cast for insertion of the threaded anchorage member, and a collar within the ferrule so as to be tapped by the anchorage member when the anchorage member is inserted in the tubular cavity, so as to retain the anchorage member within the ferrule.

Preferably, the collar is located at a middle portion of the ferrule, and protrudes beyond an external dimension of the ferrule for retaining the ferrule within the concrete component.

In accordance with another aspect of the present invention, there is provided a support for the insert described above, wherein the support has a base portion for fastening to formwork, and an insert portion for inserting into the tubular cavity of the insert so as to locate the insert in place during casting of the concrete component about the insert.

Preferably, the insert portion has at least one rib which slides into one of the grooves of the insert to prevent rotation of the insert relative to the support when the insert portion is inserted in the tubular cavity. More preferably, the insert portion has the same number of ribs as the insert has grooves, and the ribs are configured such that each one of the ribs slides into a corresponding one of the grooves when the insert portion is inserted in the tubular cavity.

Preferably, the base portion is shaped so as to form a void in the concrete component about the opening of the insert.

DESCRIPTION OF THE FIGURES

The invention is described, by way of non-limiting example only, with reference to the accompanying drawings in which.

DETAILED DESCRIPTION

Figure 1:
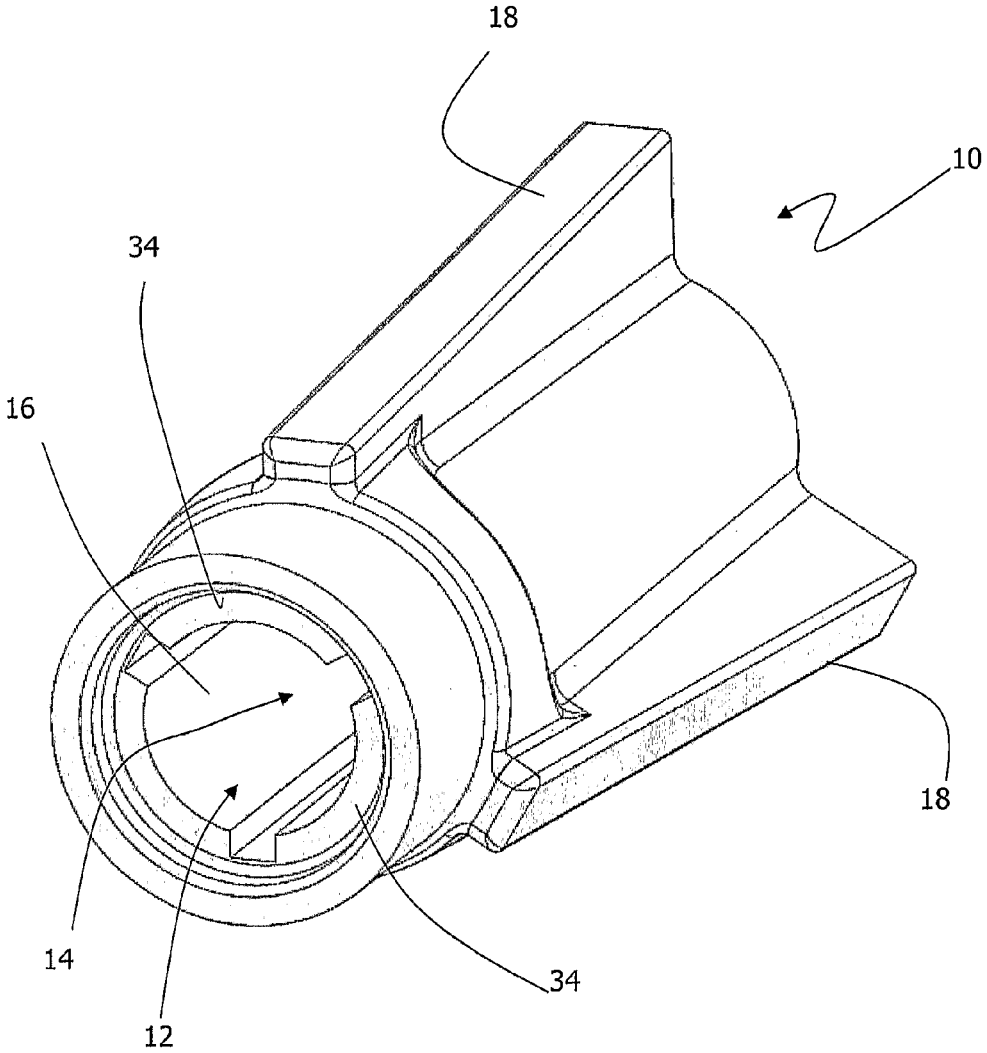
FIG. 1 is a perspective view of an insert in accordance with an example of the present invention.

A tubular insert 10 for embedment in a concrete component during casting is shown in FIGS. 1 to 4 of the accompanying drawings and includes a tubular cavity 12 for receiving an anchorage member, for example a threaded self-tapping anchorage member. The tubular cavity 12 has an opening 14 arranged to face outward of the concrete component for insertion of the threaded anchorage member. The insert 10 is externally tapered such that, when the insert 10 is embedded in a cast concrete component and the anchorage member is threadedly engaged within the tubular cavity 12, axial loading applied to the anchorage member in a sense to withdraw the anchorage member from the insert 10 causes reactional force from the surrounding concrete to be applied to the insert 10 in a direction radially inwardly of the insert 10. The insert 10 is made of deformable plastic material such that the reactional force from the surrounding concrete causes the insert 10 to deform inwardly and to exert force radially inwardly upon the anchorage member.

An end of the insert 10 opposite the opening 14 is closed to prevent ingress of concrete into the tubular cavity 12 during casting.

The external tapering of the insert 10 is provided by way of longitudinally tapered radial fins 18 which form part of the external surface of the insert 10. In the example depicted in the drawings, the longitudinally tapered fins 18 are evenly spaced about the external surface of the insert 10, and extend along a substantial part of the length 20 of the insert 10.

An internal surface 16 of the insert 10 which defines the tubular cavity 12 is provided with longitudinally extending grooves 22. The insert 10 has the same number of grooves 22 as it does fins 18, three of each in the case of the example depicted, and each groove 22 is located midway between a respective pair of neighbouring fins 18.

Figure 2A:
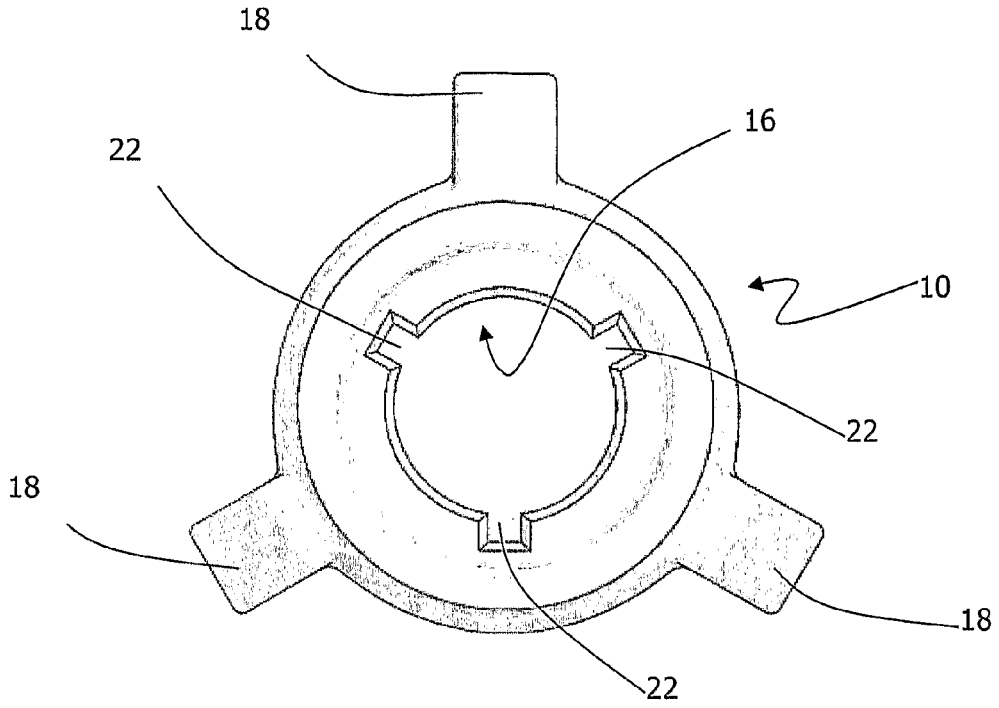
FIG. 2A is an end view of the insert shown in FIG. 1.
Figure 2B:
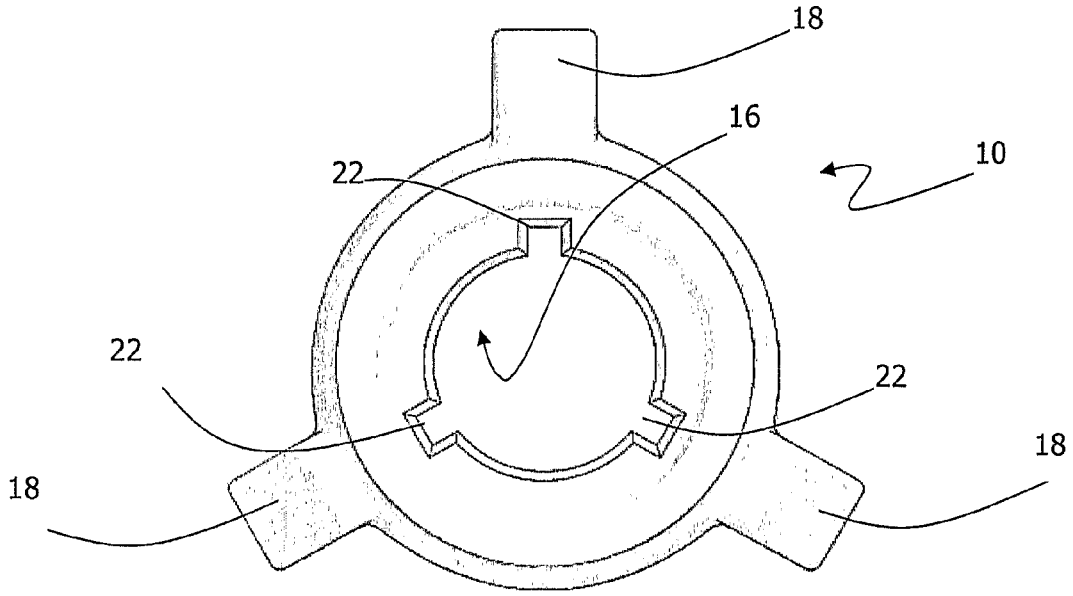
FIG. 2B is an end view of an alternative insert.
Figure 3:
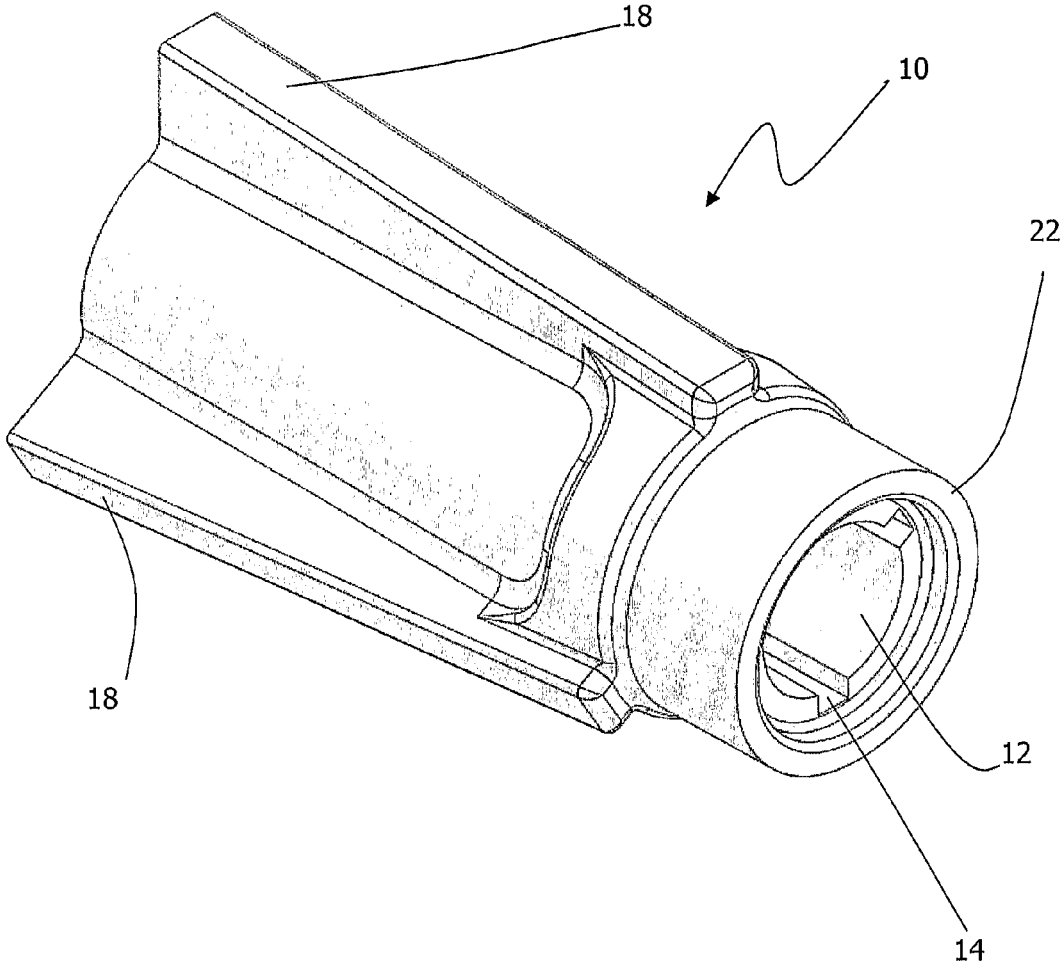
FIG. 3 is a perspective view of the insert shown in FIGS. 1 and 2A.
Figure 4:
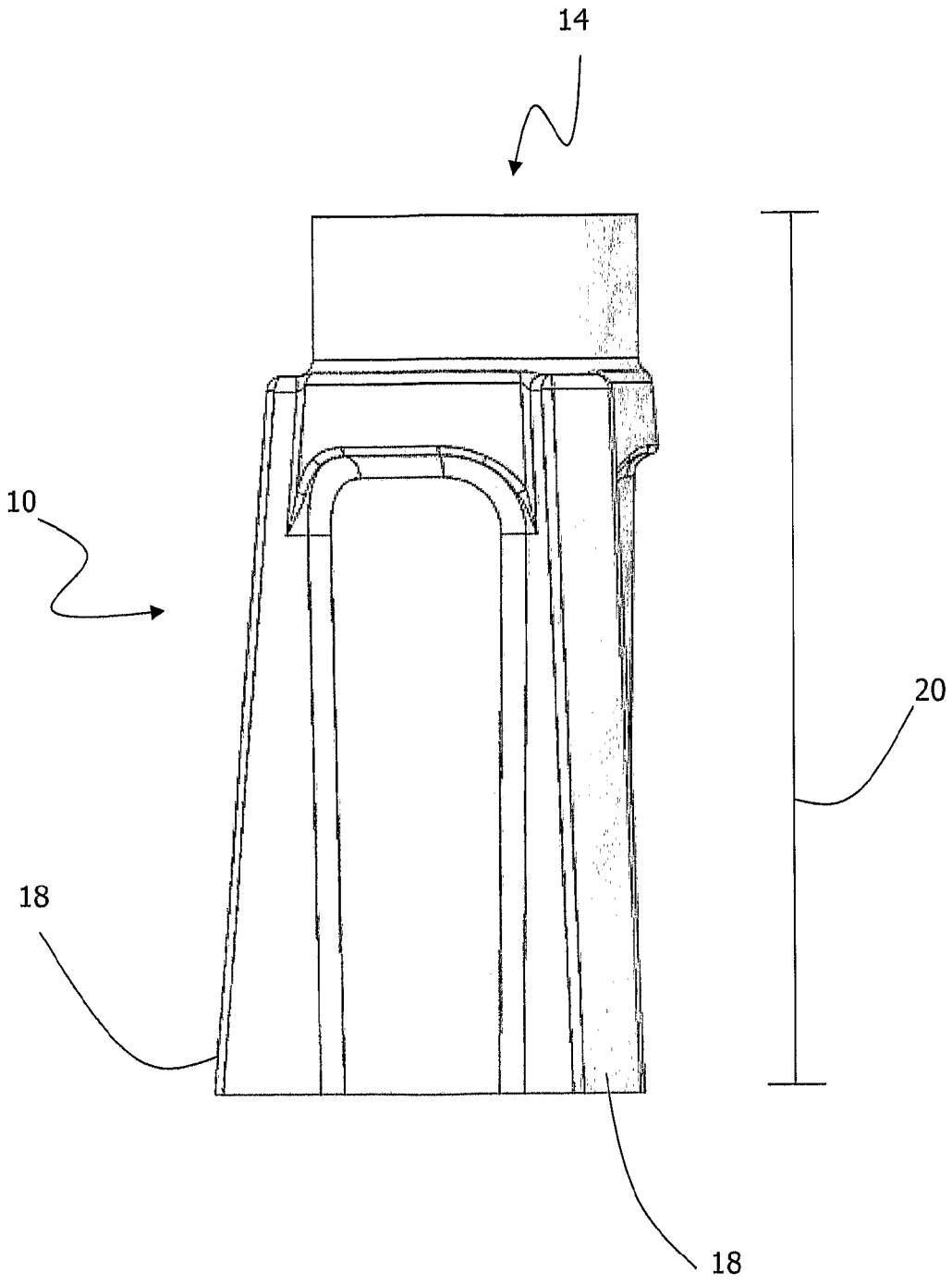
FIG. 4 is a side view of the insert shown in FIGS. 1, 2A and 3.

With reference to FIG. 2B, an alternative insert may have the same number of grooves 22 as it does fins 18, with each groove located in line with a corresponding fin 18.

Figure 5:
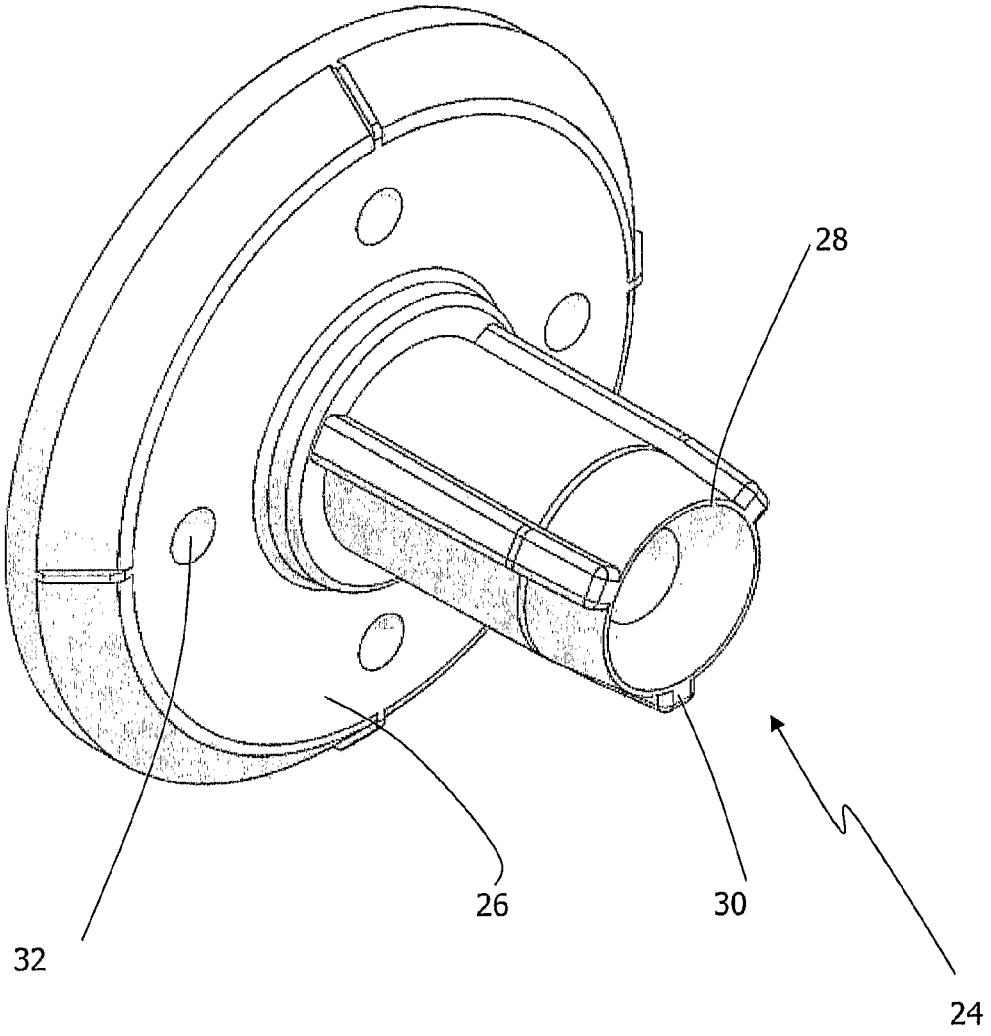
FIG. 5 is a perspective view of a support for the insert shown in FIGS. 1 to 4.
Figure 6:
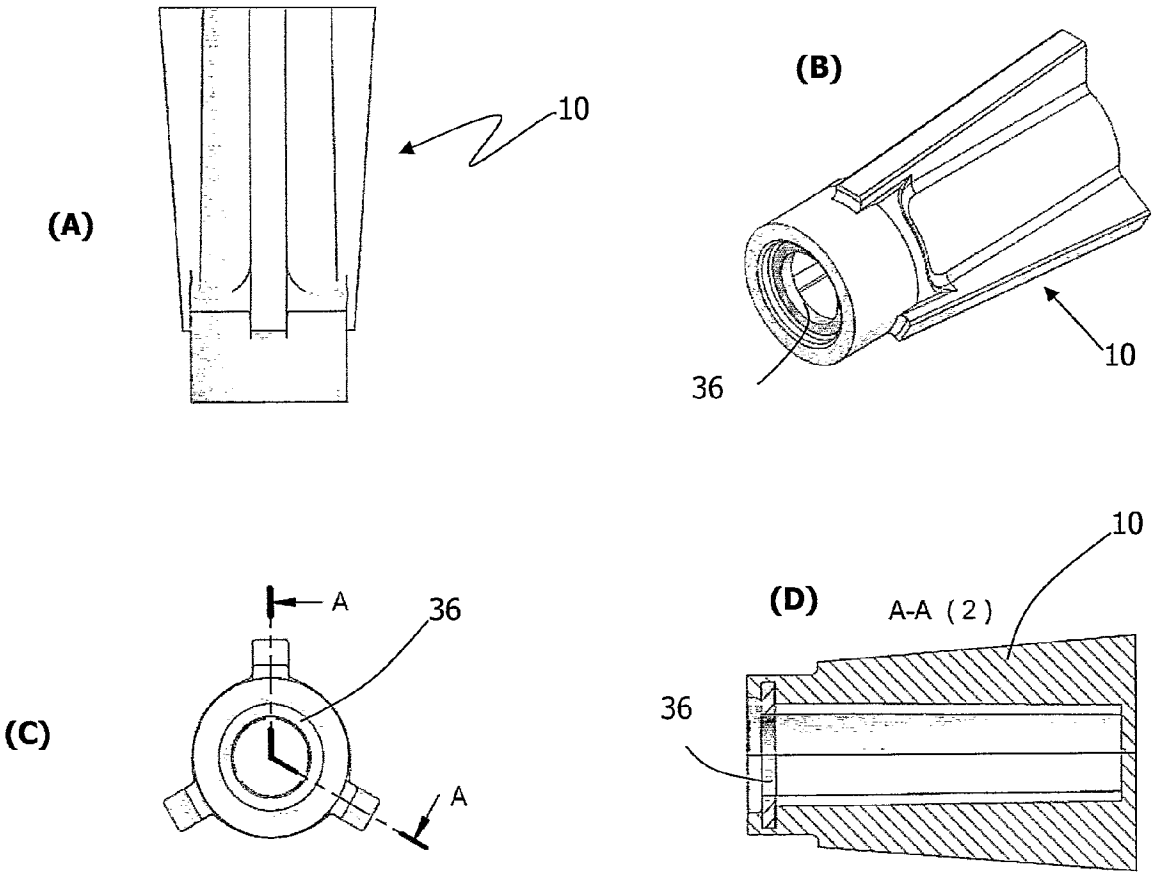
FIGS. 6A to 6D show side, perspective, end and cross-sectional views of an insert having a steel collar around a front portion of the insert, in accordance with a first example.
Figure 7:
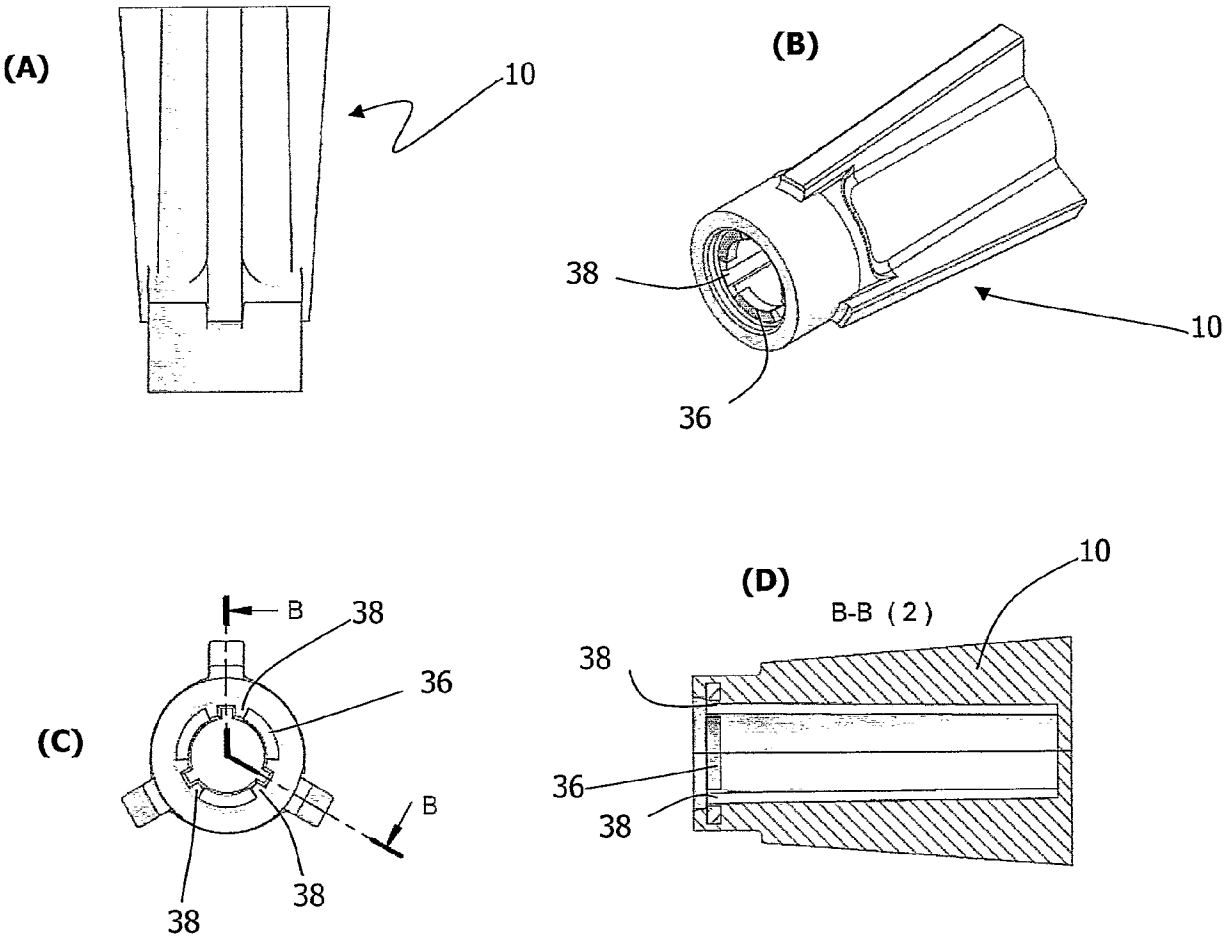
FIGS. 7A to 7D show side, perspective, end and cross-sectional views of an insert having a steel collar around a front portion of the insert, in accordance with a second example.
Figure 8:
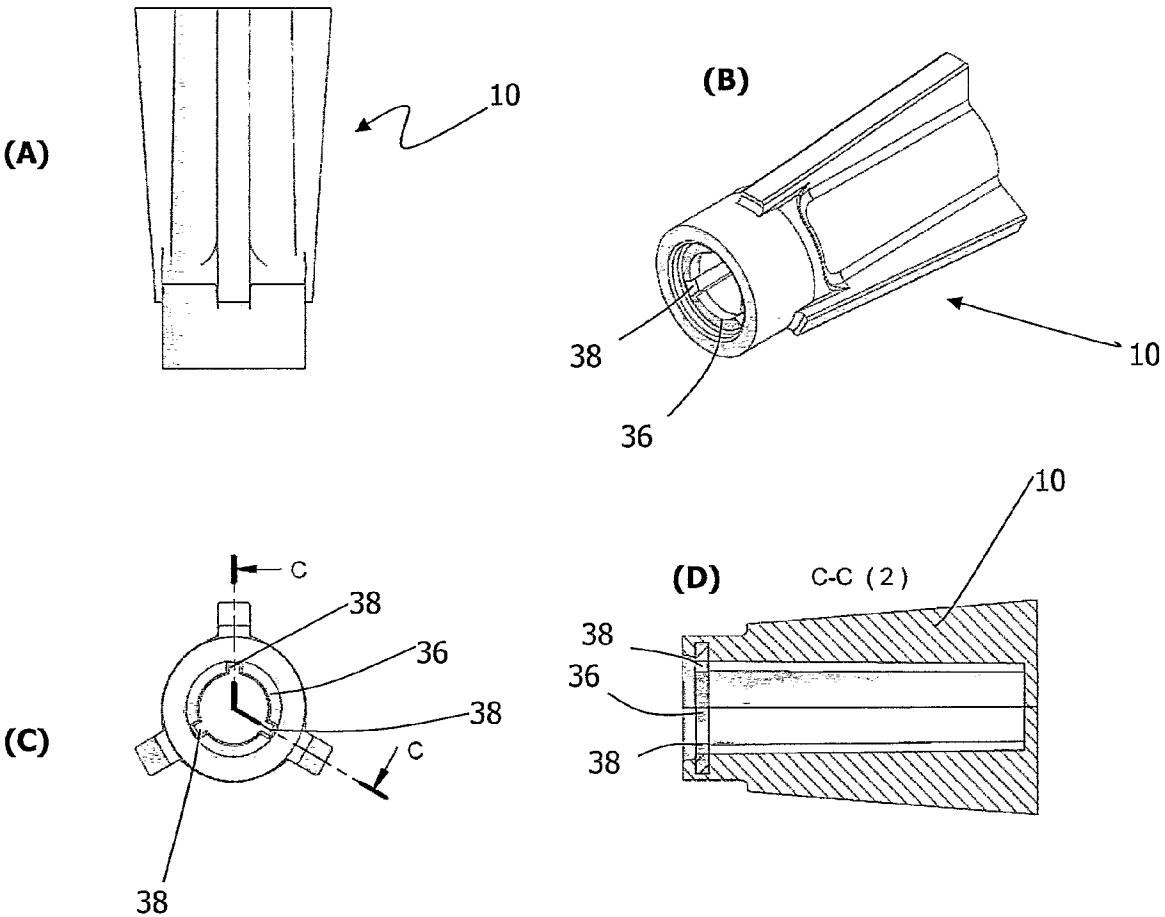
FIGS. 8A to 8D show side, perspective, end and cross-sectional views of an insert having a steel collar around a front portion of the insert, in accordance with a third example.
Figure 9:
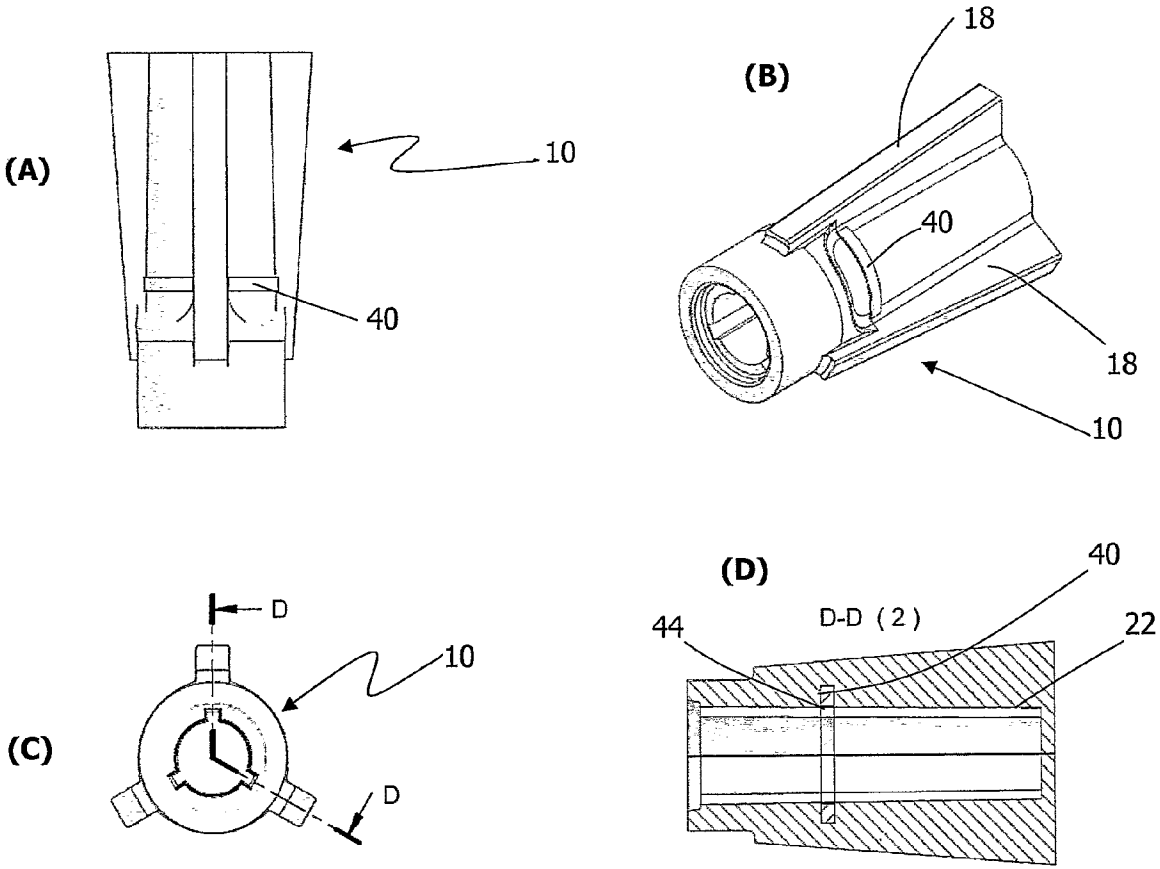
FIGS. 9A to 9D show side, perspective, end and cross-sectional views of an insert having a steel plate located in a middle portion of the insert.

The insert 10 may be held in place during casting of the concrete component by a support 24 as shown in FIG. 5. The support 24 has a base portion 26 for fastening to formwork, and an insert portion 28 for inserting into the tubular cavity 12 of the insert 10 so as to locate the insert 10 in place during casting of the concrete component about the insert 10.

The insert portion 28 has three ribs 30, located such that each of the ribs 30 slides into a corresponding one of the grooves 22 of the insert 10 when the insert portion 28 is inserted in the tubular cavity 12, so as to prevent rotation of the insert 10 relative to the support 24. Although in the example shown the insert portion 28 has the same number of ribs 30 as the insert 10 has grooves 22, in alternative examples the insert portion 28 may have fewer ribs 30 than the insert 10 has grooves 22, while still providing sufficient rotational retention of the insert 10 by virtue of at least one rib 30 of the insert portion 28 being located in one of the grooves 22 in combination with a snug fit between the two parts.

The base portion 26 has a raised profile so as to form a void in the concrete component about the opening of the insert 10, and has apertures 32 through which fasteners may be driven so as to fasten the support 24 to formwork and the like.

In use, prior to pouring of concrete, the support 24 is fastened to formwork by inserting fasteners through the apertures 32, and the insert 10 is supported in place by sliding the insert 10 over the insert portion 28 of the support 24, with the broader ends of the tapered fins 18 facing away from the base portion 26. The insert 10 is positively located on the support 24 by virtue of the grooves 22 of the insert 10 sliding over the ribs 30 of the support 24.

The concrete is then poured and set to form the concrete component. The support 24 is thereafter removed from the insert 10 with the formwork when it is taken from around the concrete component. The support 24 may then be used to hold other like inserts in place during casting of other concrete components.

The insert 10 is retained in the cast concrete component by virtue of the tapered fins 18 which abut against the surrounding concrete, and tend to compress the insert 10 radially inwardly when the insert 10 is urged outwardly of the concrete component by loading applied to an anchorage member threadedly engaged within the tubular cavity 12. More specifically, the insert 10 embedded in the concrete component is able to be used to provide anchorage to a threaded anchorage member by screwing the threaded anchorage member into the tubular cavity 12 of the insert 10 such that a thread of the threaded anchorage member cuts a corresponding retaining thread in the internal surface 16 of the insert 10. Once anchored securely within the insert 10 in this way, when loading is applied to the anchorage member axially of the anchorage member in a sense to withdraw the anchorage member from the insert 10, the external tapering of the insert 10 (and, specifically, the tapering of the fins 18) results in reactional forces being exerted from the surrounding concrete to the insert 10 in a direction radially inwardly of the insert 10. As the insert 10 is made from plastic material capable of deformation, the inward reactional forces from the surrounding concrete cause the insert 10 to deform inwardly and to, in turn, apply radially inward force against the anchorage member, thus holding the anchorage member more tightly as axial loading is increased. In this way the insert 10 has a collet-like function in constricting about the anchorage member as the axial loading applied to the anchorage member is increased.

The tapering of the insert 10 is sufficient such that, under operational loads applied to the anchorage member, the insert 10 is not able to be withdrawn through the aperture formed in the concrete component at the outward end of the insert 10.

The applicant has determined that a self-tapping anchorage member such as of the type referred to by the trade mark "AnkaScrew" would be particularly suitable for use with the insert 10, as it would be effective in cutting a corresponding thread in the internal surface 16 of the insert 10 and, by virtue of its relatively large thread pitch and relatively shallow thread depth would not displace excessive material from the insert 10 to inhibit insertion. In the case of the AnkaScrew anchor, the self-tapping insertion of the anchor is facilitated by the grooves 22 being able to accommodate material from the insert 10 as the material is displaced during formation of the thread.

The insert 10 of the example described is formed of plastic which, advantageously, is able to deform somewhat so as to enable the collet-type function. The provision of the grooves 22 also enables the collet-type function of the insert by defining therebetween a series of angularly spaced surfaces 34 which contract onto the anchorage member in jaw-like fashion in response to the reactional force. In the example insert 10 depicted in the drawings, each of the spaced surfaces 34 is part-cylindrical such that, in combination, the spaced surfaces 34 surround the tubular cavity 12.

Locating the grooves 22 midway between respective pairs of neighbouring fins 18 also assists in providing the collet-type function by ensuring that, under loading, inward reactional force from the surrounding concrete to the insert 10 is applied centrally to the spaced surfaces 34 to encourage tighter constriction about the anchorage member.

The applicant has identified that, when formed of plastic, the insert 10 is well-suited for use with an anchorage member having a screw thread with a saw-tooth design, particularly of the kind which is adapted for use with plastic bosses.

With reference to FIGS. 6A to 9D, the applicant has also identified that it may be advantageous for the insert to be provided with a steel collar around a front portion of the insert (see FIGS. 6A to 8D) and/or with a steel collar or plate located at a middle portion of the insert (see FIGS. 9A to 9D). More specifically, plastic on its own can easily shear between the threads and thus may be susceptible to pull-out. Insertion of a steel plate into the insert through which the screw or bolt has to also deform as it cuts its thread through the plate prevents the plastic from being able to be sheared out in total, as it is then held in by the plate. The steel plate provides far better shear resistance than the plastic alone.

Also, with plastic on its own, there is a tendency for the bolt or screw to wind itself out as there is a lot of pressure on the bolt by the plastic and a lot less frictional resistance between plastic on steel than steel on steel. Hence, insertion of the steel plate thus provides a frictional load between the plate and the screw or bolt and thus provides resistance to vibration and the bolt or screw winding out, particularly coarse thread bolts or screws.

In essence, the steel collar/plate provide far greater shear resistance for the insert as well as far greater pull-out capacity. Frictional forces are also increased to prevent the screw or bolt in the insert unwinding out, particularly with coarse pitch bolts and screws.

Accordingly, FIGS. 6A to 6D show side, perspective, front and cross-sectional views of an insert 10 which is provided with a steel collar 36 around a front portion of the insert. The steel collar 36 is annular, and of constant cross-section. With reference to FIGS. 7A to 7D, in accordance with a second example, the insert 10 may be provided with a steel collar 36 which has slots 38 corresponding in location to the grooves 22 in the plastic. The slots 38 are larger in width than the width of the grooves 22 such that the grooves 22 extend into the slots 38.

In a third example, as shown in FIGS. 8A to 8D, the steel collar 36 may be provided with slots 38 which have the same width as the width of the grooves 22, with the slots 38 being positioned in line with the grooves 22.

With reference to FIGS. 9A to 9D, the insert 10 may have a steel collar or plate 40 located at a middle portion 42 of the insert 10. The steel plate 40 has a central aperture so as to allow the threaded anchorage member to pass through the plate 40, and has slots 44 which are located in line with the grooves 22. The plate 40 may protrude beyond an outer dimension of the insert 10 between the fins 18, as shown.

Figure 10:
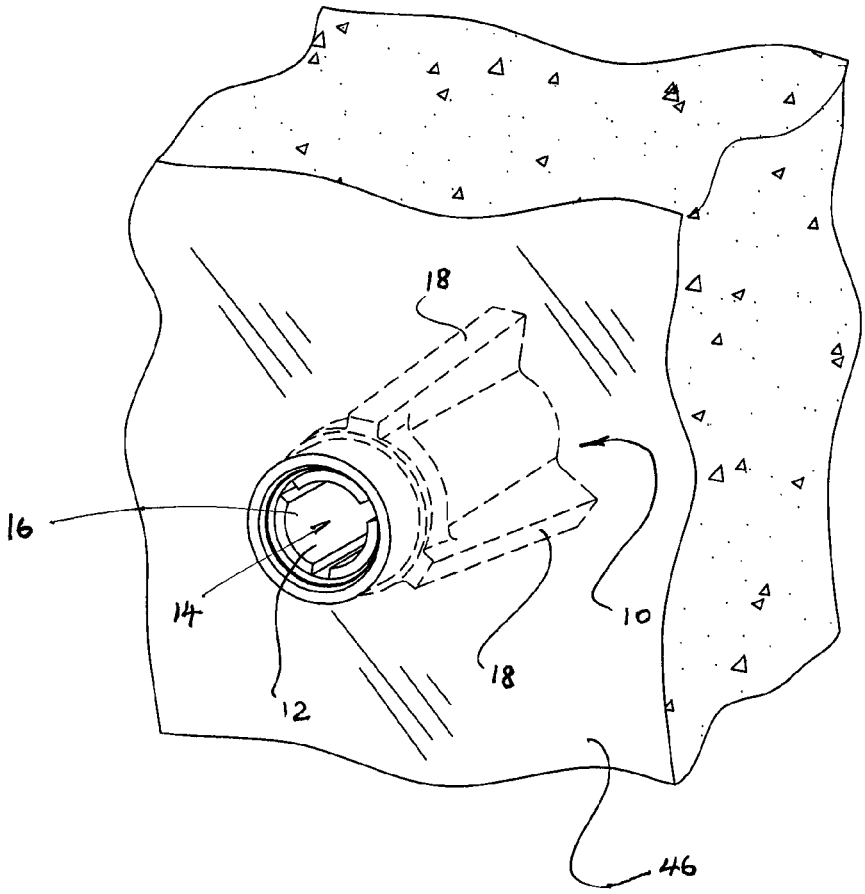
FIG. 10 shows an external view of the insert of FIGS. 9A to 9D when cast into a concrete component, with hidden parts of the insert shown in broken lines.
Figure 11:
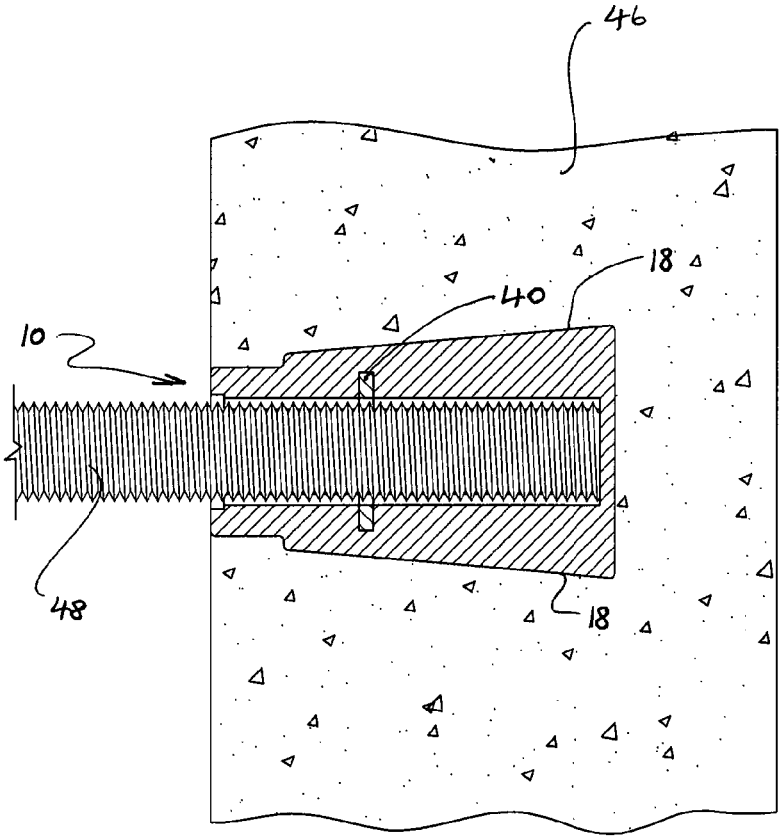
FIG. 11 shows the insert and concrete component of FIG. 10, shown in a cross-sectional view taken along a longitudinal central plane of the insert similar to the cross-sectional view of FIG. 9D.

FIG. 10 shows an external view of the insert 10 of FIGS. 9A to 9D when cast into a concrete component 46, with hidden parts of the insert 10 depicted in broken lines. FIG. 11 shows the insert 10 and concrete component 42 of FIG. 10, shown in a cross-sectional view taken along a longitudinal central plane of the insert 10 similar to the cross-sectional view of FIG. 9D, with a threaded anchorage member 48 threaded into the insert 10. As can be seen in these drawings, the insert 10 is cast into the concrete component 46 such that, when the anchorage member 48 is threadedly engaged within the tubular cavity of the insert 10, axial loading applied to the anchorage member 48 in a sense to withdraw the anchorage member 48 from the insert 10 causes reactional force from the surrounding concrete of the component 46 to be applied to the insert 10 in a direction radially inwardly of the insert 10. The insert 10 is formed of deformable plastic material such that said reactional force in turn causes the insert 10 to exert force radially inwardly upon the anchorage member 48.

Advantageously, the insert described above is inexpensive, being formed from plastics, and, unlike prior cast ferrules it is not formed with an internal thread at the time of manufacture. The insert is relatively light and has broad application to reduced load situations and to temporary anchorage situations where it is not to be under load for a long period.

The above insert and support therefor have been described by way of example only and modifications are possible within the scope of the invention. For example, although the collar/plate is described as being formed of steel, it will be understood that in other examples the collar/plate may be formed of other materials, including other metals.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. In combination:

a concrete component;

a threaded anchorage member; and a cast-in insert embedded in the concrete component during casting, of the concrete component, wherein the cast-in insert has a tubular cavity for receiving the threaded anchorage member, the tubular cavity has an opening facing outward of the concrete component for insertion of the threaded anchorage member, wherein the insert is externally tapered such that when the anchorage member is threadedly engaged within the tubular cavity, axial loading applied to the anchorage member to withdraw the anchorage member from the insert causes reactional force from the surrounding concrete to be applied to the insert in a direction radially inwardly of the insert, wherein the insert is formed of deformable plastic material such that said reactional force in turn causes the insert to exert force radially inwardly upon the anchorage member; and wherein an internal surface defining the tubular cavity is provided with grooves extending longitudinally of the insert, the grooves defining therebetween a series of angularly spaced surfaces which contract onto the anchorage member in response to the reactional force.

2. A combination as claimed in claim 1, wherein the spaced surfaces are tapped by the anchorage member when the anchorage member is inserted in the tubular cavity.

3. A combination as claimed in claim 2, wherein the external tapering of the insert is provided by way of longitudinally tapered fins arranged along an external surface of the insert.

4. A combination as claimed in claim 2, including a collar located around the tubular cavity.

5. A combination as claimed in claim 1, wherein the external tapering of the insert is provided by way of longitudinally tapered fins arranged along an external surface of the insert.

6. A combination as claimed in claim 5, including a collar located around the tubular cavity.

7. A combination as claimed in claim 1, including a collar located around the tubular cavity.

8. A combination as claimed in claim 7, wherein the collar is arranged so as to be tapped by the anchorage member when the anchorage member is inserted in the tubular cavity.

9. A combination as claimed in claim 8, wherein the collar is located at a front portion of the insert.

10. A combination as claimed in claim 8, wherein the collar is located at a middle portion of the insert, and protrudes beyond an external dimension of the insert.

11. A combination as claimed in claim 8, wherein the collar is formed of metal.

12. A combination as claimed in claim 7, wherein the collar is located at a front portion of the insert.

13. A combination as claimed in claim 12, wherein the collar is formed of metal.

14. A combination as claimed in claim 7, wherein the collar is located at a middle portion of the insert, and protrudes beyond an external dimension of the insert.

15. A combination as claimed in claim 14, wherein the collar is formed of metal.

16. A combination as claimed in claim 7, wherein the collar is formed of metal.

17. A combination as claimed in claim 1, wherein the grooves extend the length of the internal surface defining the tubular cavity of the insert.

* * * * *